US006422774B1

(12) United States Patent
Jito

(10) Patent No.: US 6,422,774 B1
(45) Date of Patent: Jul. 23, 2002

(54) LIQUID APPLICATOR FOR APPLYING A LIQUID TO A PORTION OF A WIRING HARNESS, USE THEREOF AND METHOD FOR APPLYING A LIQUID TO A PORTION OF A WIRING HARNESS

(75) Inventor: Hitoshi Jito, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/907,410

(22) Filed: Jul. 17, 2001

(30) Foreign Application Priority Data

Feb. 8, 2000 (JP) ..... 2000-234350

(51) Int. Cl.[7] ..... A46B 11/00
(52) U.S. Cl. ..... 401/11; 401/9
(58) Field of Search ..... 401/11, 9, 10, 401/12

(56) References Cited

U.S. PATENT DOCUMENTS

| | | | | |
|---|---|---|---|---|
| 439,916 A | * | 11/1890 | Whittlesey | 401/11 |
| 4,069,894 A | * | 1/1978 | Black | 401/11 |
| 5,122,056 A | * | 6/1992 | Barbee | 401/11 |

FOREIGN PATENT DOCUMENTS

| | | |
|---|---|---|
| DE | 38 26 989 | 2/1990 |
| EP | 0 376 131 | 4/1990 |
| JP | 6-236714 | 8/1994 |
| JP | 7-105758 | 4/1995 |
| JP | 8-17270 | 1/1996 |
| JP | 9-159069 | 6/1997 |
| JP | 10-50154 | 2/1998 |
| JP | 11-7851 | 1/1999 |

* cited by examiner

*Primary Examiner*—David J. Walczak
(74) *Attorney, Agent, or Firm*—Antony J. Casella; Gerald E. Hespos

(57) ABSTRACT

An adhesive applicator for smoothly applying a liquid adhesive to a branch wire assembly tube before it is inserted into a main wire assembly tube of a wiring harness. The applicator applies a suitable amount of a liquid adhesive through discharge nozzles (9) immediately after a branch wire assembly tube is placed on a semi-cylindrical adhesive coating member (2). The adhesive supplied to a receiving surface (3) is applied to the branch wire assembly tube over its entire circumference by reciprocating pins (6) along engaging grooves (8) to pivot the adhesive coating member (2) along the circumferential surface of the branch wire assembly tube.

12 Claims, 7 Drawing Sheets

LIQUID APPLICATOR FOR APPLYING A LIQUID TO A PORTION OF A WIRING HARNESS, USE THEREOF AND METHOD FOR APPLYING A LIQUID TO A PORTION OF A WIRING HARNESS

BACKGROUND OF THE INVENTION

1. Field of the Invention

The invention relates to a liquid applicator for applying a liquid to a portion of a wiring harness. Moreover, the invention relates to a method for applying a liquid to a portion of a wiring harness.

2. Description of the Related Art

Wiring harnesses in an automotive vehicle are branched in a complicated manner. For example, FIG. 5 shows a wiring harness W/H where a single bundle of wires W is split into two branch wire bundles Wa and Wb. A cylindrical main wire assembly tube Wh is mounted over the wire bundle W to form a main wire assembly Wh that has one end in proximity to the branch wire bundles Wa and Wb. Cylindrical branch wire assembly tubes TBa and TBb are put on the branch wire bundles Wa and Wb respectively to form branch wire assemblies Wha and Whb that branch off from the main wire assembly Wh. Ends of the branch wire assembly tubes TBa and TBb are inserted into an end of a cylindrical main wire assembly tube TB by about 20 mm.

The main wire assembly tube TB and the branch wire assembly tubes TBa, TBb often are secured to each other by taping. However, as shown in FIG. 5, an adhesive may be use instead of a tape. The adhesive typically has been applied with a needle-type adhesive injector 51 to inject a liquid adhesive into a clearance between the main wire assembly tube TB and the branch wire assembly tubes TBa, TBb. Waterproofing can be applied simultaneously if the respective tubes TB, Tba and TBb are secured by the adhesive.

However, a needle 51*a* of the injector 51 may not be inserted properly due to a narrow clearance between the respective tubes TB, TBa, TBb. As a result the adhesive may not be applied properly. Alternatively, a forcibly inserted needle 51*a* may tear the main wire assembly tube TB. These situations may affect the adequacy of the adhesive connection of the tubes.

In view of the above, an adhesive container 52 with a liquid adhesive is placed upside down, as shown in FIG. 6. A sponge 53 then can be pressed against a mouth of the adhesive container 52 to remove the necessary amount of adhesive. Thereafter, as shown in FIG. 7, the sponge 53 is successively rubbed against one end of each branch wire assembly tube TBa, TBb to apply the adhesive 54. The ends of the branch wire assembly tubes TBa, TBb to which the adhesive 54 has been applied then are inserted into the main wire assembly tube TB. Thus, the tubes can be adhered to each other by thoroughly applying the adhesive. The process illustrated in FIGS. 6 and 7 will not tear the main wire assembly tube TB because the adhesive injector 51 and needle are not used.

The method illustrated in FIGS. 6 and 7 requires considerable manual work, and it is fairly cumbersome to apply the adhesive on the sponge 53 with considerable frequency. Additionally, the operation of rubbing the sponge 53 with the adhesive against the branch wire assembly tubes TBa, TBb easily soils the operator. Thus, applying adhesive in the manner described above is a large burden on the operator.

In view of the above problems, an object of the present invention is to provide a liquid applicator and a method for applying a liquid that allows an easier application of the liquid to a portion of a wiring harness.

SUMMARY OF THE INVENTION

The invention is directed to a liquid applicator for applying a liquid, preferably a liquid adhesive, to an outer circumferential surface of a portion of a wiring harness. The liquid applicator comprises a liquid coating member with a concave receiving surface for contact with the portion of the wiring harness that is to be coated with the liquid. The liquid applicator further comprises a stand for pivotally supporting the liquid coating member, a liquid supplying means for supplying the liquid to the receiving surface of the liquid coating member, and a pivoting means for pivoting the liquid coating member circumferentially relative to the portion of the wiring harness to be coated with the liquid. Thus, the liquid can be applied substantially over the entire circumference of the selected portion of the wiring harness by pivoting the liquid coating member.

According to a preferred embodiment, the concave receiving surface is a substantially semi-cylindrical receiving surface.

The liquid applicator preferably is an adhesive applicator for applying a liquid adhesive to an outer circumferential surface of a branch wire assembly tube as a step in a wiring harness assembling process. The process may include: placing a main wire assembly tube on a main wire assembly of a wiring harness; applying adhesive to an end of the branch wire assembly tube with an adhesive applicator; putting the branch wire assembly tube on a branch wire assembly branched off from the main wire assembly of the wiring harness; and inserting the leading adhesive-coated end of the branch wire assembly tube into an end of the main wire assembly tube. The adhesive applicator comprises an adhesive coater with a substantially semi-cylindrical receiving surface that can be fit to one end of the branch wire assembly tube. The adhesive applicator further comprises a stand for pivotally supporting the adhesive coater, an adhesive supplying means for supplying the adhesive to the receiving surface of the adhesive coater, and a pivoting means for pivoting the adhesive coater in the circumferential direction of the branch wire assembly tube. Thus, adhesive can be applied to the branch wire assembly tube over its entire circumference by pivoting the adhesive coater with the pivoting means.

The liquid coating member preferably comprises a foamed material, such as a sponge, in which the adhesive or other such is permeable.

The pivoting means may comprise pins that project at each of the opposite ends of the liquid coater with respect to its longitudinal direction, and a pair of arcuate guide means for guiding the pins to pivot the liquid coater. The guide means preferably comprise arcuate rings that face opposite ends of the liquid coater with respect to its longitudinal direction. Each arcuate ring is frame-shaped to define an arcuate engaging groove therein and the pins are fit slideably in the corresponding engaging grooves.

One end of the branch wire assembly tube is placed on the receiving surface of the adhesive coater that has been set at a suitable height. Thus, a lower portion of the outer circumferential surface of the branch wire assembly tube fits in the receiving surface of the adhesive coater. The liquid adhesive is supplied to the receiving surface by the adhesive supplying means, and the supplied adhesive is applied to the lower portion of the outer circumferential surface of the tube in contact with the receiving surface. Adhesive is applied to the remainder of the tube by using the pivoting means to pivot the adhesive coating member in the circumferential direction of the branch wire assembly tube. Therefore, the receiving surface supplied with the adhesive is rubbed against the outer circumferential surface of the cylindrical branch wire assembly tube. As a result, the adhesive is applied to the branch wire assembly tube over its entire circumference.

Accordingly, the adhesive supplying means quickly supplies the liquid adhesive to the receiving surface on which the branch wire assembly tube is placed, and the adhesive supplied to the receiving surface is applied quickly to the branch wire assembly tube merely by employing the pivoting means to pivot the adhesive coating member. Therefore, the adhesive can be applied efficiently to the one end of the branch wire assembly tube before it is inserted into the main wire assembly tube of the wiring harness.

The liquid applicator preferably further comprises switching means for controlling the supply of liquid from the liquid supplying means. The switching means preferably activates the supply of liquid when the portion of the wiring harness to be coated with the liquid is inserted into the liquid coating member.

The adhesive supplying means preferably automatically supplies the adhesive when the branch wire assembly tube is placed on the receiving surface of the adhesive coating member. With this construction, the adhesive is supplied to the receiving surface of the adhesive coating member without performing any particular adhesive supplying operation, and only by placing the branch wire assembly tube on the receiving surface. The supplied adhesive then quickly permeates the adhesive coating member and naturally spreads through a wide area of the receiving surface. Thus, the adhesive can be applied more smoothly and thoroughly.

The adhesive coating member is substantially semi-cylindrical in a preferred embodiment, and therefore the receiving surface is a curved surface of 180°. Thus, the adhesive can be applied substantially over the entire circumference of the branch wire assembly tube by pivoting the adhesive coating member by 90° to left and right.

The invention also is directed to a method for applying a liquid, such as a liquid adhesive, to an outer circumferential surface of a portion of a wiring harness. The method comprises inserting the portion of the wiring harness to be coated into a concave receiving surface of a liquid coating member that is supported pivotally on a stand. The method proceeds by supplying the liquid to the receiving surface of the liquid coating member, and pivoting the liquid coating member in the circumferential direction of the portion of the wiring harness to be coated with the liquid. As a result, the liquid is applied to the portion of the wiring harness substantially over its entire circumference.

The method may further comprise activating the supply of liquid when the portion of the wiring harness to be coated with the liquid is at least partly inserted into the liquid coating member.

The application step preferably comprises applying a liquid adhesive to an outer circumferential surface of a branch wire assembly tube as part of a wiring harness assembling process. The process may further comprise putting the branch wire assembly tube around the branch wire assembly branched off from a main wire assembly of a wiring harness, inserting the leading end of the branch wire assembly tube into an end of the main wire assembly tube put on or around the main wire assembly, and then securing the branch wire assembly tube and a main wire assembly tube by the adhesive.

These and other objects, features and advantages of the present invention will become apparent upon reading of the following detailed description of preferred embodiments and accompanying drawings.

DETAILED DESCRIPTION OF THE PREFERRED EMBODIMENT

Figure 1:
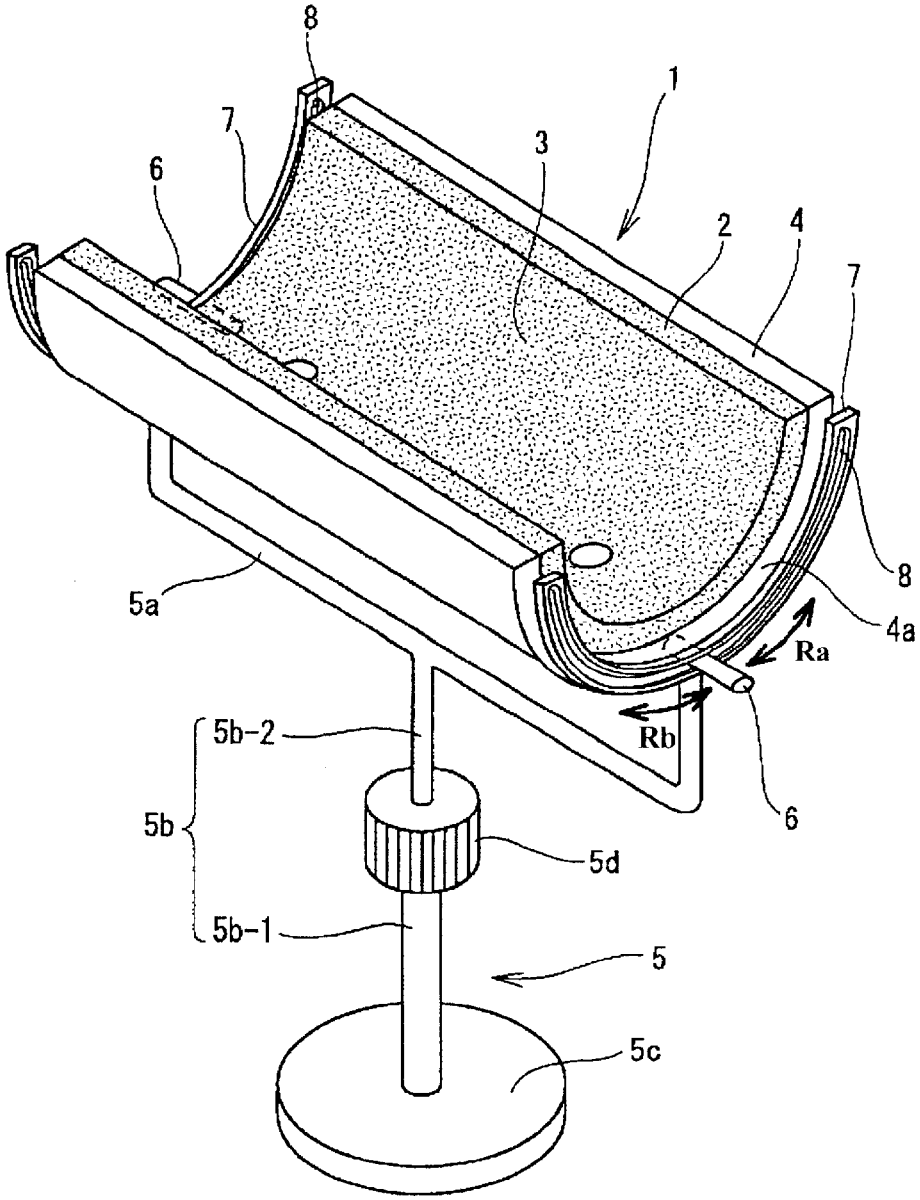
FIG. 1 is a perspective view showing an essential construction of an adhesive applicator according to one embodiment of the present invention.

An adhesive applicator in accordance with the invention is identified by the numeral 1 in FIG. 1. The adhesive applicator 1 is provided with an adhesive coating member 2 that has an upwardly facing concave receiving surface 3. The adhesive coating member 2 preferably defines a cylindrical arc of about 180° and the concave receiving surface 3 preferably defines an inside radius slightly greater than the outside radius of the branch wire assembly tube. Additionally, the adhesive coating member 2 has a length substantially equal to the length of a section of a branch wire assembly tube that is to be inserted into a main wire assembly tube. Thus, the lower half of the outer circumferential surface of the branch wire assembly tube can be held in contact with the concave receiving surface 3. A substantially semi-cylindrical base 4 is fixed to the outer circumferential surface of the adhesive coating member 2, and opposite longitudinal ends 4*a* and 4*b* of the base 4 are supported by a support stand 5 so that the receiving surface 3 faces up or towards a direction along which the branch wire tube is to be fed.

The base 4 is supported on the support stand 5 by engaging pins 6 that project outwardly from the ends 4*a*, 4*b* of the base 4. Additionally, the support stand 5 has arcuate rings, guide rails or beams 7 that face the respective ends 4*a*, 4*b* of the base 4. Each arcuate ring 7 is substantially frame-shaped and has an arcuate engaging groove or recess 8 therein. The engaging grooves 8 preferably extend over 180° and the pins 6 fit slideably in the engaging grooves 8.

The branch wire assembly tube is placed on the adhesive coating member 2 between the arcuate rings 7, and the adhesive coating member 2 is pivoted along the circumferential direction of the branch wire assembly tube together with the base member by moving the pins 6 along the engaging grooves 8. Thus, the adhesive coating member 2 is pivoted by a simple engaging mechanism comprised of the pins 6 of the adhesive coating member 2 and the engaging grooves 8 of the support stand 5.

Although an operator moves the pins 6 manually in this embodiment, they may be moved mechanically or automatically, for example, by an electric motor.

The support stand 5 has a substantially U-shaped supporting bar 5*a* fixed on the upper surface of a vertical leg 5*b*. Opposite ends of the support bar 5*a* are fixed to the middle of the lower surfaces of the arcuate rings 7.

The leg 5*b* has a lower leg 5*b*-1 that stands on a base plate 5*c*, and an upper leg 5*b*-2 that is telescopically insertable into the lower leg 5*b*-1. Thus, the receiving surface 3 of the adhesive coating member 2 can be set at a suitable height by loosening a nut 5*d* and adjusting a projecting distance of the upper leg 5*b*-2 from the lower leg 5*b*-1.

Figure 2:
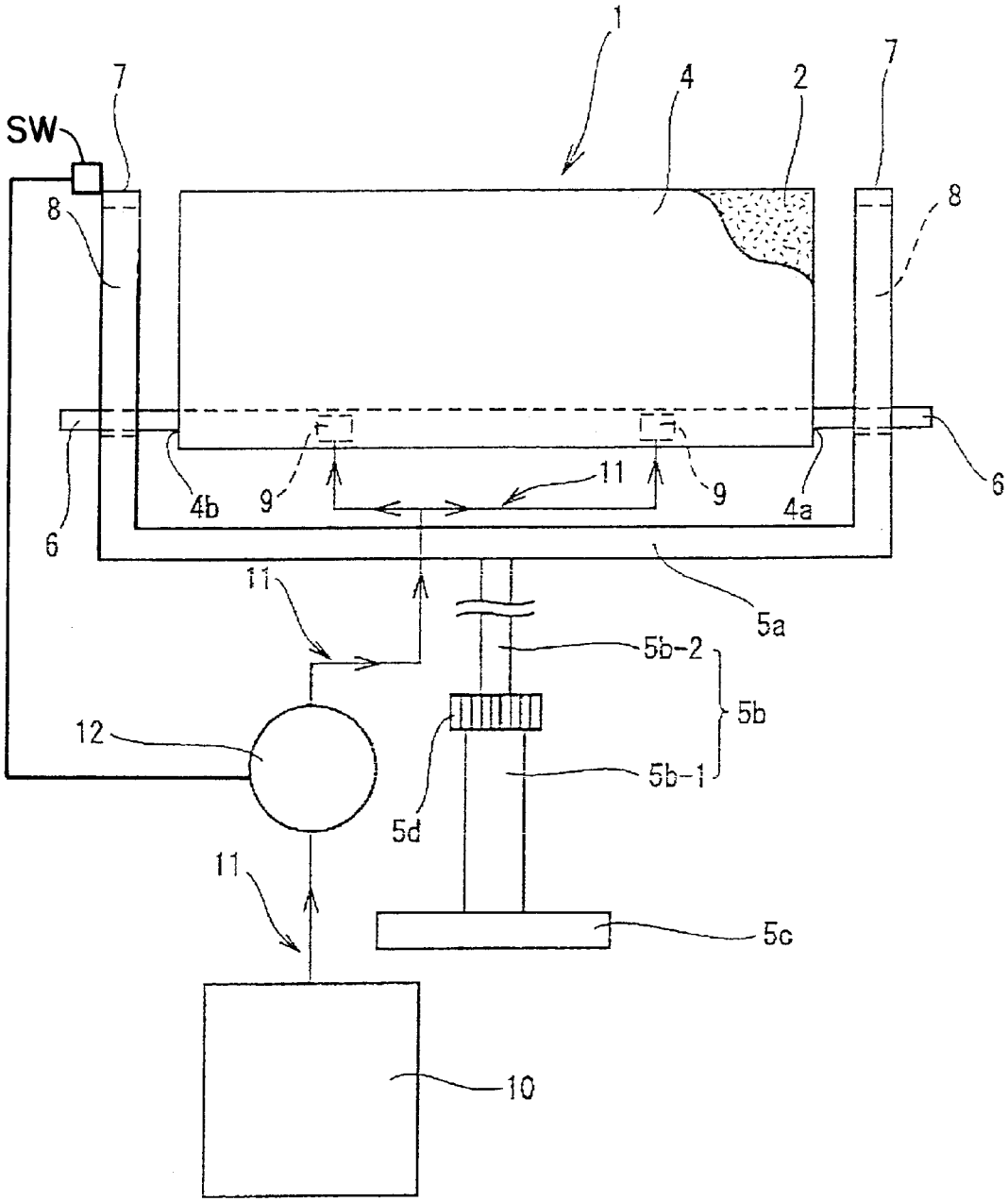
FIG. 2 is a schematic front view showing the entire construction of the adhesive applicator.

As shown in FIG. 2, an adhesive supply means is provided for supplying a liquid or semi-liquid adhesive, sealant, or the like to the receiving surface 3 of the adhesive coating member 2. The supply means preferably comprises two discharge nozzles 9 embedded in the adhesive coating member 2 and the base member 4 so that discharge openings at the leading ends of the discharge nozzles 9 are exposed at the receiving surface 3. The supply means further comprises an adhesive tank 10 for storing the liquid adhesive, a pipe 11 for connecting the discharge nozzles 9 and the adhesive tank 10, and a liquid feeding pump 12 for feeding the adhesive in the adhesive tank 10 to the pipe 11. The liquid adhesive is supplied to the receiving surface 3 through the discharge openings of the discharge nozzles 9 as the liquid feeding pump 12 is actuated.

The adhesive supplying means is constructed to automatically supply a suitable amount of the adhesive when the branch wire assembly tube is placed on the receiving surface 3. In this embodiment, a switching means SW is turned or automatically turns on when the branch wire assembly tube is placed on the receiving surface 3 together with a wire bundle to put a load on the discharge nozzles 9, thereby actuating the liquid feeding pump 12. The switching means may comprise an electrical/mechanical switch, a proximity switch, an optical sensor switch and/or an induction switch. This embodiment is convenient because the adhesive is supplied to the receiving surface 3 only by placing the branch wire assembly tube on the receiving surface 3 without performing any particular adhesive supplying operation. It should be appreciated that the present invention is also applicable to non-automatic adhesive applicators in which the liquid feeding pump 12 is actuated when an operator manually turns on a switch.

The adhesive coating member 2 is made of a material, such as a sponge, that allows the adhesive to permeate. The sponge enables the adhesive to be supplied to the receiving surface 3 quickly, permeates in the adhesive coating member 2 and naturally spreads through the entire receiving surface 3 by capillary and/or diffusion. Thus, the adhesive can be applied thoroughly.

Figure 3:
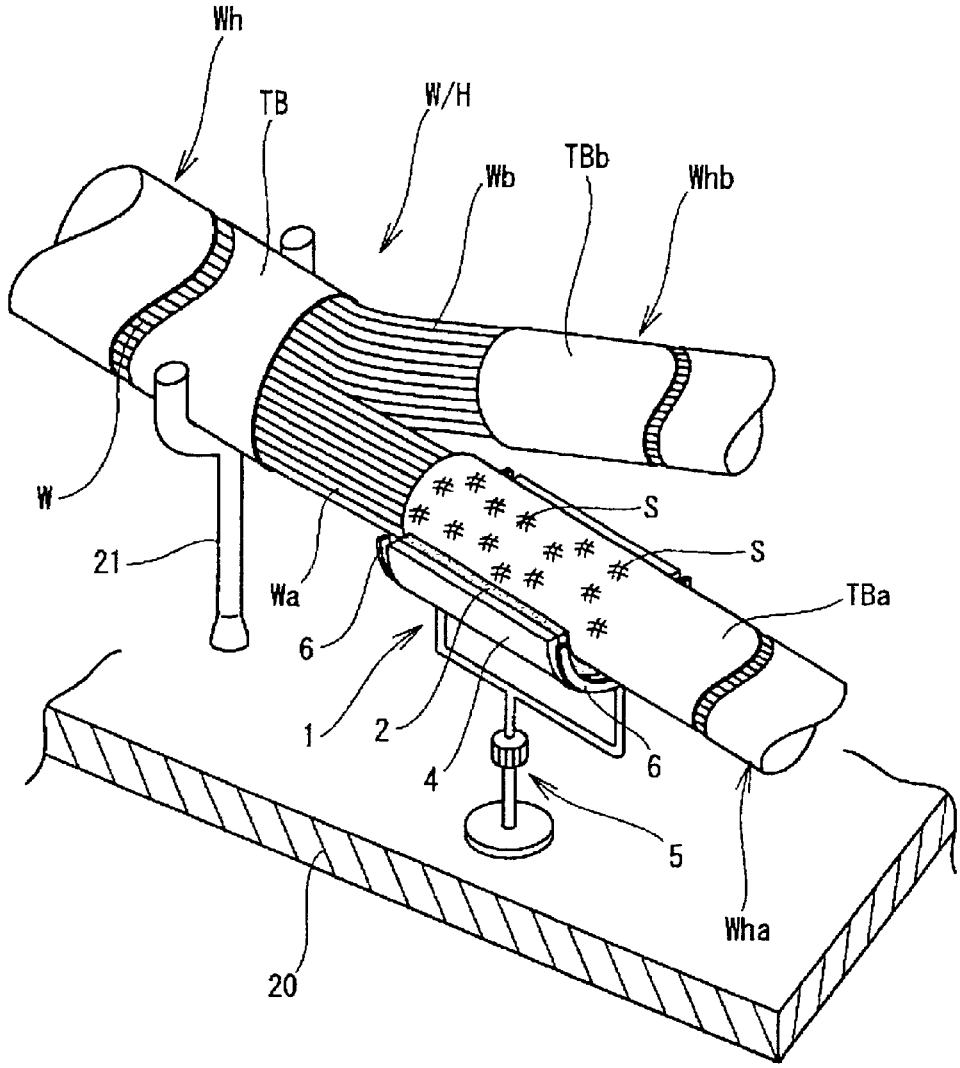
FIG. 3 is a perspective view showing a state where an adhesive is being applied by the adhesive applicator.
Figure 4:
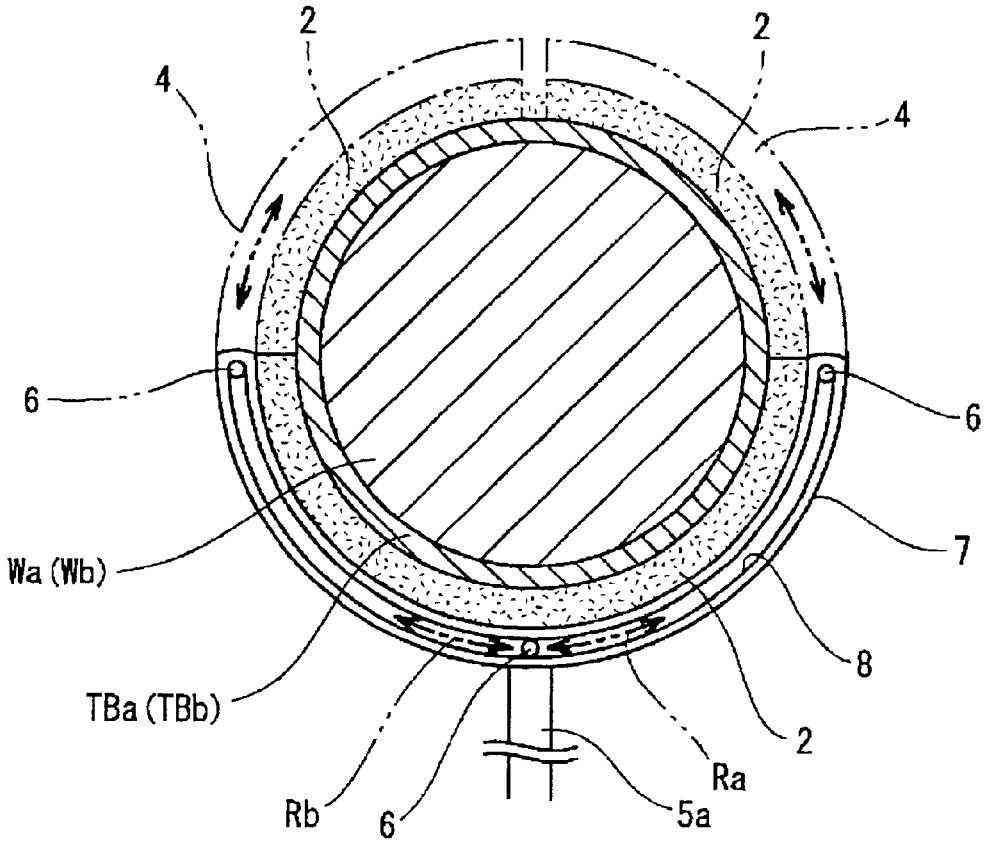
FIG. 4 is a side view showing a pivoting state of an adhesive coating member of the adhesive applicator.
Figure 5:
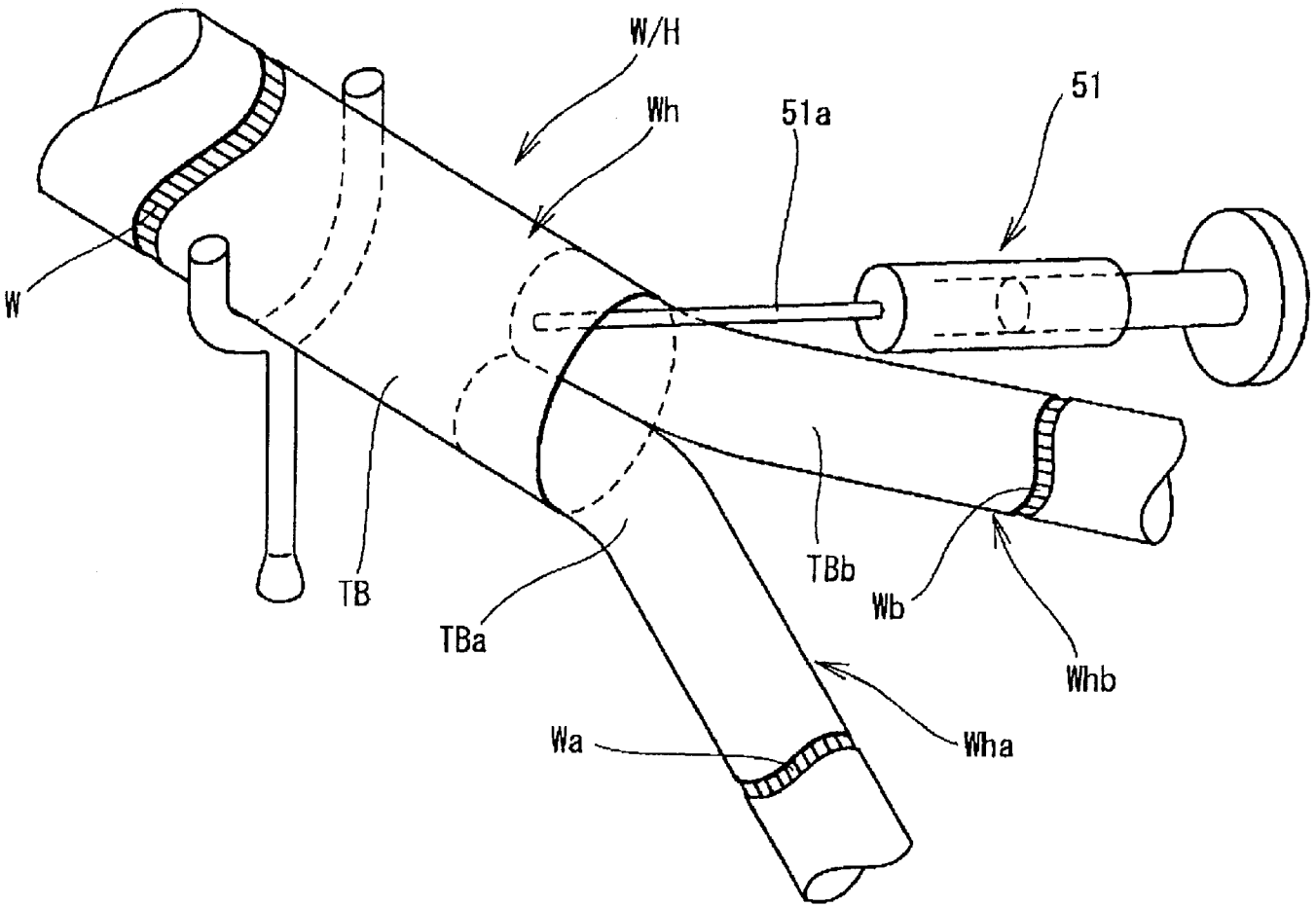
FIG. 5 PRIOR ART
FIG. 5 is a perspective view showing a conventional adhesive applying method.
Figure 6:
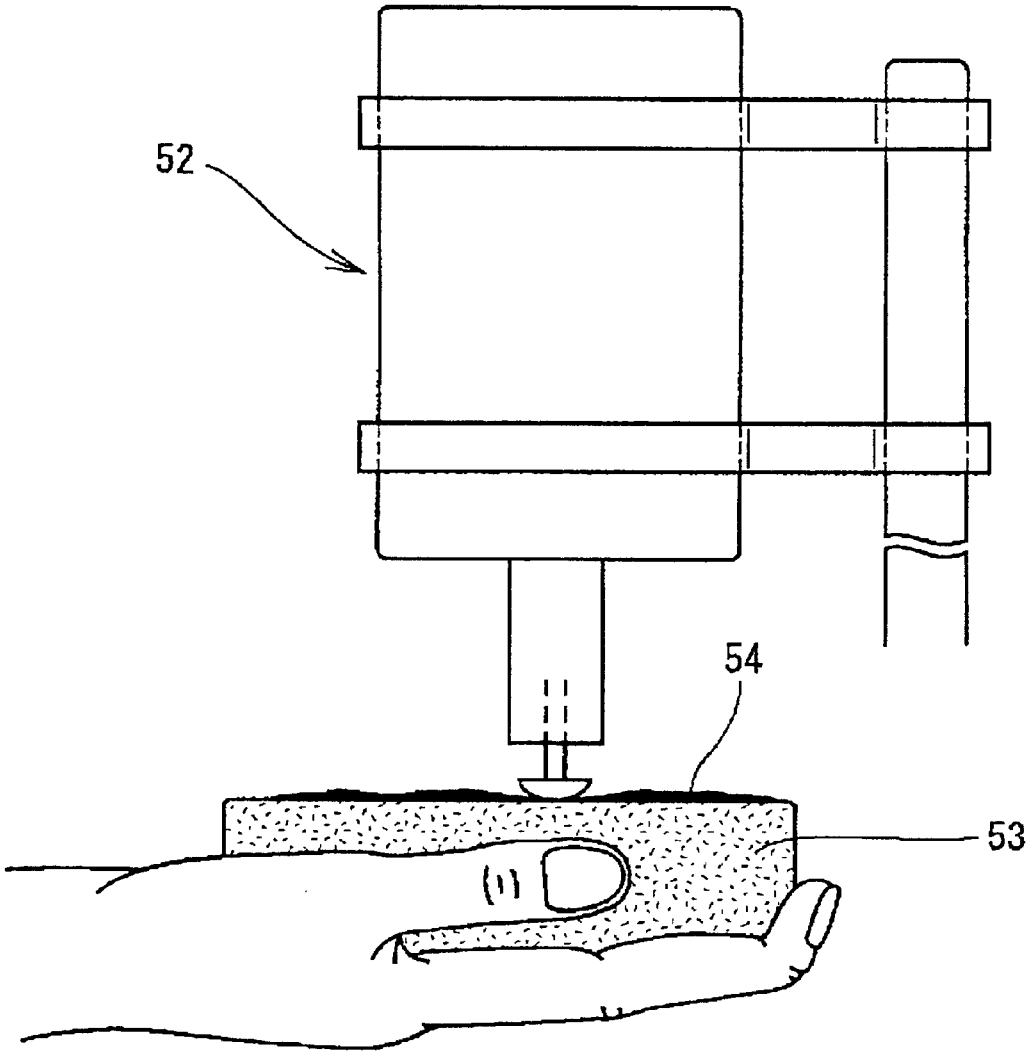
FIG. 6 PRIOR ART
FIG. 6 is a schematic front view showing a state where an adhesive is supplied to a sponge according to another conventional adhesive applying method.
Figure 7:
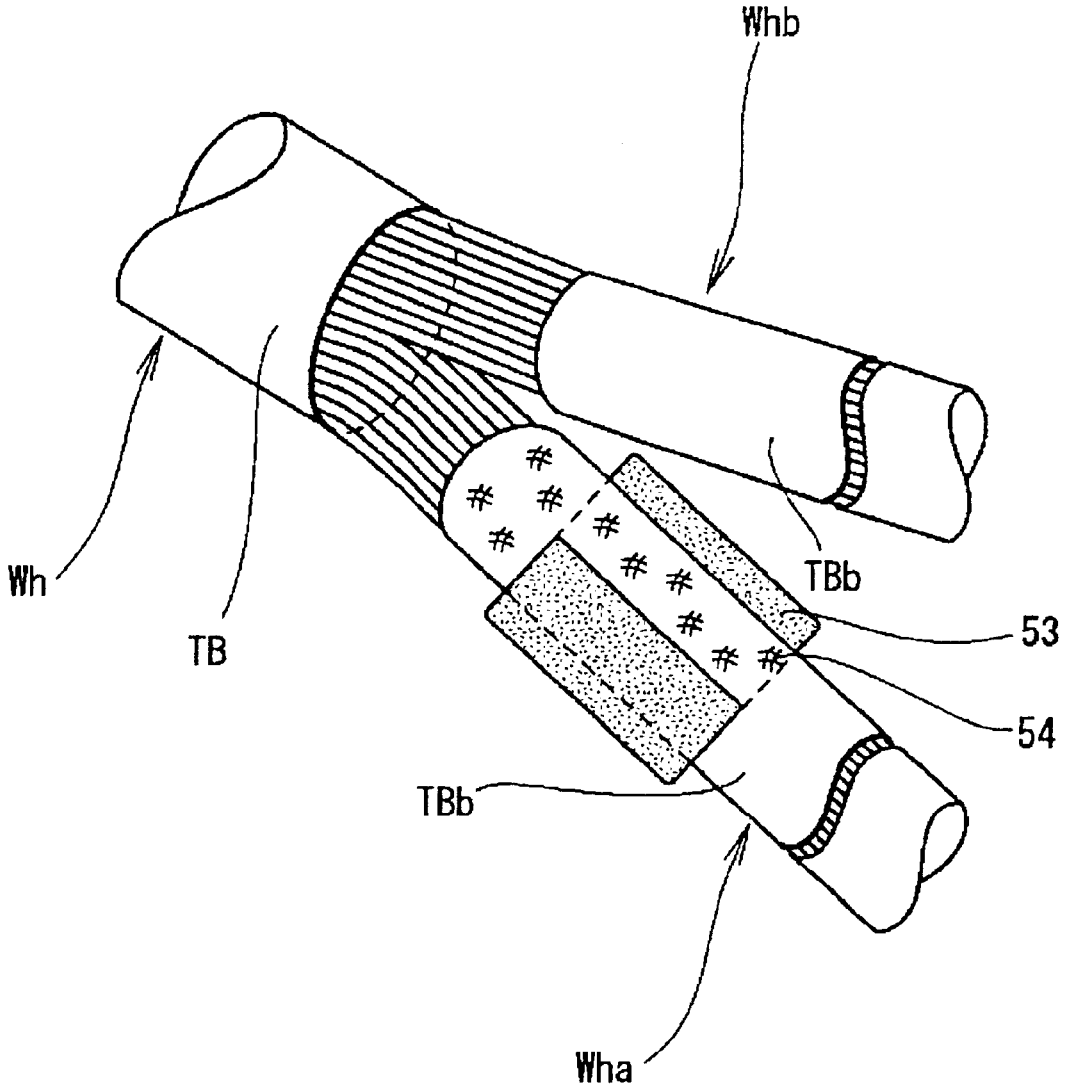
FIG. 7 PRIOR ART
FIG. 7 is a perspective view showing a state where the sponge is rubbed against a branch wire assembly tube according to another conventional adhesive applying method.

As shown in FIG. 3, the adhesive applicator 1 stands on the upper surface of a wiring harness assembling table 20. A cylindrical main wire assembly tube TB is put at least partly on or around at least a portion of a wire bundle W that forms a main wire assembly Wh of a wiring harness W/H, and substantially cylindrical branch wire assembly tubes TBa, TBb are put on wire bundles Wa, Wb forming branch wire assemblies Wha, Whb branched off from the main wire assembly Wh. The respective tubes TB, TBa, TBb preferably are polyvinyl chloride tubes (PVC tubes).

The receiving surface 3 of the adhesive coating member 2 is set at a suitable height on the assembling table 20 by adjusting a projecting distance of the upper leg 5*b*-2.

One end of the branch wire assembly tube TBa to which the adhesive is to be applied is placed on the receiving surface 3 together with the wire bundle Wa while aligning the longitudinal direction of the branch wire assembly tube TBa with that of the adhesive coating member 2. Even if the adhesive coating member 2 is pivoted in this state, the branch wire assembly and the tube TBa are held in a fixed position because the main wire assembly and the branch wire assembly are held by an other wire laying jig 21.

The liquid feeding pump 12 is actuated automatically to supply a suitable amount of the adhesive to the receiving surface 3 immediately after the branch wire assembly tube TBa is placed on the receiving surface 2. As a result, the adhesive is applied to the lower half of the outer circumferential surface of the branch wire assembly tube Tba that had been placed in contact with the receiving surface 3.

Next, the operator pivots the pins 6 by 90° in directions of arrows Ra, Rb along the respective engaging grooves 8, as shown in FIGS. I and 4. The operator may also pivot the engaging ribs 6 by an amount less than 90°, preferably in case the receiving surface 2 covers a range exceeding 180°, e.g. up to about 220°. If the receiving surface 2 covers an angle less than 180°, then the operator may pivot the engaging ribs by an angle more than 90° to ensure that the liquid is applied to substantially the entire circumference of the portion of the wiring harness W/H to be coated. As a result, the receiving surface 3 of the adhesive coating member 2 is brought into contact with the upper half of the outer circumferential surface of the branch wire assembly tube TBa to apply the adhesive. The receiving surface 3 with the adhesive spread therethrough is rubbed against the entire outer circumferential surface of the branch wire assembly tube TBa by repeatedly and reciprocatingly pivoting the adhesive coating member 2. Therefore, the adhesive S can be applied thoroughly at a uniform thickness to the one end of the branch wire assembly tube TBa.

The end of the branch wire assembly tube TBa with the adhesive is inserted into an end of the main wire assembly tube TB by about 20 mm while having its diameter made smaller. Likewise, the branch wire assembly tube TBb is inserted into the end of the main wire assembly tube TB after the adhesive is applied. As a result, the main wire assembly tube and the branch wire assembly tubes can be secured thoroughly to each other over their entire circumferences by the adhesive.

In the above adhesive applicator 1, the liquid adhesive can be supplied automatically quickly to the receiving surface 3 by the adhesive supplying means, and the adhesive supplied to the receiving surface 3 can be applied efficiently and thoroughly to the branch wire assembly tubes TBa, TBb only by moving the pins 6 to pivot the adhesive coating member 2. Thus, the adhesive can be applied smoothly to the ends of the branch wire assembly tubes TBa, TBb before they are inserted into the main wire assembly tube TB of the wiring harness W/H.

As is clear from the above description, in the inventive adhesive applicator for applying the adhesive or liquid to the outer circumferential surface of the tube, the adhesive or other liquid can be supplied quickly by the liquid/adhesive supplying means to the receiving surface on which the branch wire assembly tube is placed. Additionally, the adhesive supplied to the receiving surface can be applied quickly to the branch wire assembly tube only by pivoting the adhesive coating member by the pivoting means. Thus, the adhesive or other liquid can applied smoothly to the one end of the branch wire assembly tube before it is inserted into the main wire assembly tube of the wiring harness.

The adhesive or other liquid preferably is supplied automatically when the branch wire assembly tube is placed on the receiving surface of the adhesive coating member. The adhesive coating member preferably is made of a material that allows the adhesive to permeate or diffuse. Thus, the adhesive is supplied to the receiving surface without performing any particular adhesive supplying operation and the supplied adhesive quickly permeates in the adhesive coating member and naturally spreads through a wide area of the receiving surface. Therefore, the adhesive can be applied more smoothly and thoroughly. This effect may be enhanced by providing a plurality of liquid or adhesive nozzles distributed substantially all over the adhesive coating member.

Further, the pivoting means can be constructed by an engaging mechanism of the pins at the adhesive coating member and the locking grooves provided at the supporting stand.

Even though the description of preferred embodiments was given with particular emphasis to the application or coating of a portion of a wiring harness with glue or adhesive, it should be understood that it may be also applied to any other type of liquid having a sufficient viscosity such as a liquid sealant or the like.

What is claimed is:

1. A liquid applicator for applying a liquid to an outer circumferential surface of a portion of a wiring harness, comprising:

a liquid coating member provided with a substantially semi-cylindrical concave receiving surface configured for contact with the portion of the wiring harness to be coated with the liquid, a liquid supply means for supplying the liquid to the receiving surface of the liquid coating member, and a pivoting means for pivoting the liquid coating member at least partly around the outer circumferential surface of the portion of the wiring harness for applying the liquid to the portion, wherein the pivoting means comprises pins projecting at opposite longitudinal ends of the liquid coating member, and a pair of arcuate guide means for guiding the pins to pivot the liquid coating member.

2. The liquid applicator of claim 1, wherein the guide means comprises arcuate rings facing the opposite longitudinal ends of the liquid coating member, each arcuate ring being frame-shaped and defining an arcuate engaging groove therein, the pins being slideably fit in the corresponding engaging grooves.

3. The liquid applicator of claim 2, wherein at least one of said engaging grooves is a semi-circular slot, and wherein at least one of said pins is dimensioned to pass through the respective slot.

4. A liquid applicator for applying a liquid to an outer circumferential surface of a portion of a wiring harness, comprising:

a liquid coating member provided with a concave receiving surface configured for contact with the portion of the wiring harness to be coated with the liquid;

a liquid supply means for supplying the liquid to the receiving surface of the liquid coating member;

a pivoting means for pivoting the liquid coating member at least partly around the outer circumferential surface of the portion of the wiring harness for applying the liquid to the portion; and switching means for controlling the supplying of the liquid from the liquid supply means, the switching means activating the supplying of the liquid when the portion of the wiring harness to be coated with the liquid is inserted into the liquid coating member.

5. A method for applying a liquid to an outer circumferential surface of a portion of a wiring harness, comprising:

at least partly inserting the portion of the wiring harness to be coated into a liquid coating member having a concave receiving surface for bringing the portion of the wiring harness to be coated with the liquid into contact with the receiving surface, supplying the liquid to the receiving surface of the liquid coating member, and pivoting the liquid coating member at least partly around the outer circumferential surface of the portion of the wiring harness to be coated with the liquid for applying the liquid to the portion substantially over its entire circumference.

6. The method of claim 5, further comprising activating the supply of liquid when the portion of the wiring harness to be coated with the liquid is inserted into the liquid coating member.

7. The method of claim 5, wherein the portion of the wiring harness is a branch wire assembly tube put around a branch wire assembly branched off from a main wire assembly of a wiring harness, the main wiring harness comprising a main wire assembly tube put around the main wire assembly, and wherein the liquid is applied to a leading end of the branch wire assembly tube, the method further comprising inserting the leading end of the branch wire assembly tube into an end of the main wire assembly tube put around the main wire assembly.

8. An adhesive applicator for applying an adhesive to an outer circumferential surface of a branch wire assembly tube of a wiring harness, comprising:

a wiring harness assembly board;

at least one jig mounted to and extending from the wiring harness assembly board for supporting a portion of the wiring harness;

a support stand mounted to and extending from the wiring harness assembly board at a location in proximity to the jig;

an adhesive coating member mounted on the support stand and having an arcuately concave substantially semi-cylindrical receiving surface configured for contact with the branch wire assembly tube of the wiring harness, the arcuately concave semi-cylindrical receiving surface defining a longitudinal axis of symmetry about which the receiving surface is generated, at least portions of the adhesive coating member adjacent the concave receiving surface being formed from a material in which the adhesive is permeable, the adhesive coating member being mounted for rotation around the axis about which the arcuately concave semi-cylindrical receiving surface is generated; and an adhesive supply means for supplying the adhesive to the receiving surface of the adhesive coating member, whereby pivoting of the adhesive coating member applies the adhesive to the branch wire assembly tube.

9. The adhesive applicator of claim 8, wherein the adhesive coating member is pivotal about an axis extending substantially parallel to the wiring harness assembly board.

10. An adhesive applicator for applying an adhesive to an outer circumferential surface of a branch wire assembly tube of a wiring harness, comprising:

a wiring harness assembly board;

at least one jig mounted to and extending from the wiring harness assembly board for supporting a portion of the wiring harness;

a support stand mounted to and extending from the wiring harness assembly board at a location in proximity to the jig;

an adhesive coating member pivotally mounted on the support stand (5) and having an arcuately concave receiving surface configured for contact with the branch wire assembly tube of the wiring harness, at least portions of the adhesive coating member adjacent the concave receiving surface being formed from a material in which the adhesive is permeable;

wherein the support stand comprises guide frames at opposite longitudinal ends of the adhesive coating member, said guide frames being formed with semi-circular slots, pins extending from the opposite longitudinal ends of the adhesive coating member and being slideably received in the semi-circular slots of the guides frames for pivoting the liquid coating member at least partly around the outer circumferential surface of the branch wire assembly tube of the wiring harness for applying the adhesive to the branch wire assembly tube; and an adhesive supply means for supplying the adhesive to the receiving surface of the adhesive coating member, whereby pivoting of the adhesive coating member applies the adhesive to the branch wire assembly tube.

11. An adhesive applicator for applying an adhesive to an outer circumferential surface of a branch wire assembly tube of a wiring harness, comprising:

a wiring harness assembly board;

at least one jig mounted to and extending from the wiring harness assembly board for supporting a portion of the wiring harness;

a support stand mounted to and extending from the wiring harness assembly board at a location in proximity to the jig;

an adhesive coating member pivotally mounted on the support stand and having an arcuately concave receiving surface configured for contact with the branch wire assembly tube of the wiring harness, at least portions of the adhesive coating member adjacent the concave receiving surface being formed from a material in which the adhesive is permeable;

an adhesive supply means for supplying the adhesive to the receiving surface of the adhesive coating member, whereby pivoting of the adhesive coating member applies the adhesive to the branch wire assembly tube; and switching means for controlling the supplying of the adhesive from the adhesive supply means, the switching means activating the supplying of the adhesive when the portion of the wiring harness to be coated with the adhesive is inserted into the adhesive coating member.

12. The adhesive applicator of claim 10, wherein the guide frames comprise semi-circular rings.

* * * * *